US010785572B2

(12) United States Patent
Chen et al.

(10) Patent No.: US 10,785,572 B2
(45) Date of Patent: Sep. 22, 2020

(54) SPEAKER AND TERMINAL COMPONENT THEREOF

(71) Applicant: Tymphany Acoustic Technology (Huizhou) Co., Ltd., Huizhou, Guangdong Province (CN)

(72) Inventors: ZhiWen Chen, Huizhou (CN); XiaoTian Zhu, Huizhou (CN)

(73) Assignee: Tymphany Acoustic Technology (Huizhou) Co., Ltd., Huizhou, Guangdong Province (CN)

( * ) Notice: Subject to any disclaimer, the term of this patent is extended or adjusted under 35 U.S.C. 154(b) by 0 days.

(21) Appl. No.: 16/388,151

(22) Filed: Apr. 18, 2019

(65) Prior Publication Data

US 2019/0327560 A1 Oct. 24, 2019

(30) Foreign Application Priority Data

Apr. 18, 2018 (CN) ..... 2018 1 0348031

(51) Int. Cl.

| | |
|---|---|
| ***H04R 9/06*** | (2006.01) |
| ***H04R 9/02*** | (2006.01) |
| ***H04R 1/06*** | (2006.01) |
| ***H04R 9/04*** | (2006.01) |

(52) U.S. Cl.

CPC ..... *H04R 9/06* (2013.01); *H04R 1/06* (2013.01); *H04R 9/022* (2013.01); *H04R 9/025* (2013.01); *H04R 9/046* (2013.01); *H04R 2209/00* (2013.01)

(58) Field of Classification Search

CPC ..... H04R 1/06; H04R 9/022; H04R 2209/00; H04R 9/025

See application file for complete search history.

(56) References Cited

U.S. PATENT DOCUMENTS 6,243,479 B1 * 6/2001 Proni ..... H04R 9/022 381/397
2014/0348373 A1 * 11/2014 Qiu ..... H04R 31/006 381/397

* cited by examiner

*Primary Examiner* — Sunita Joshi

(74) *Attorney, Agent, or Firm* — Muncy, Geissler, Olds & Lowe, P.C.

(57) ABSTRACT

A terminal component is applied to a speaker, and includes two terminals, a sleeve seat, and two fixing heads. Each terminal includes a terminal head and a terminal body. The sleeve seat includes two terminal blocks. The two terminal blocks respectively accommodate the two terminal bodies, so that the two terminal heads are exposed outside the sleeve seat. The two fixing heads are respectively combined with the two terminal heads, to respectively fasten two wires to the two terminals.

10 Claims, 5 Drawing Sheets

SPEAKER AND TERMINAL COMPONENT THEREOF

CROSS REFERENCE TO RELATED APPLICATIONS

This nonprovisional application claims priority under 35 U.S.C. § 119 to Chinese Patent Application No. CN 201810348031.4, which was filed on Apr. 18, 2018, and which is herein incorporated by reference.

BACKGROUND

Technical Field

This application relates to a speaker and a terminal component thereof, and in particular, to a terminal component connected to a voice coil tensile wire of the speaker.

Related Art

A basic principle for sound production in a speaker is that an electronic signal is input into a voice coil so as to generate a magnetic field and a back and forth piston movement in a magnetic gap with the help of mutual attraction and repulsion actions between magnetic poles is made to the voice coil. A diaphragm vibrates according to the back and forth piston movement of the voice coil to drive the air to resonate. Auditory verves spread all over human ear membranes and, therefore, human ears can receive the vibration and hear a sound. Therefore, the electrical connection of the voice coil is critically important.

Traditionally, tensile wires of the voice coil are welded to a terminal plate for electrical connection. The terminal plate is riveted to a support piece. Therefore, interference between the terminal plate and a magnet can be prevented only when a length of the support piece is greater than an external diameter of the magnet. A larger support piece indicates a larger external diameter of a housing. In this way, overall size selection and structure design of a speaker are easily affected.

In addition, a material of the support piece is generally plastic, because the material needs to be insulated and easily molded. A support piece for a tweeter is generally not intended to be excessively thick, and even the thinner the better, so as to reduce an overall height of the voice coil. Therefore, a thickness of the support piece is generally around 1.6 mm. However, when tensile wires of the voice coil are welded to the terminal plate, a temperature (430° C.) of a solder tool easily causes the support piece to distort, leaving hidden troubles.

In addition, the terminal plate is connected to an input signal line by using two methods: (1) The signal line is directly welded to the terminal plate by soldering. The disadvantages of this process include that dismounting and changing the tweeter are inconvenient. In addition, a soldering operation may burn the plastic support piece to distort, consequently pulling apart the tensile wire of the voice coil. (2) The connection is implemented by using an interconnection component of the terminal plate. The disadvantages of this connection include that mounting and changing the tweeter are inconvenient, and pulling and inserting the interconnection component of the terminal plate require a relatively large force, consequently easy to break the plastic support piece.

SUMMARY

In view of this, certain exemplary embodiments of this application provide a speaker and a terminal component thereof. The terminal component in this application is applied to the speaker, and comprises: two terminals, a sleeve seat, and two fixing heads. Each terminal includes a terminal head and a terminal body. The sleeve seat includes two terminal blocks. The two terminal blocks respectively accommodate the two terminal bodies, so that the two terminal heads are exposed outside the sleeve seat. The two fixing heads are respectively combined with the two terminal heads, to respectively fasten two wires to the two terminals.

In an embodiment, each terminal head includes a punch hole, respectively for the two wires to pass through.

The speaker according to certain exemplary embodiments in this application includes: a voice coil, a support piece, a washer, two wires, and the terminal component described in the foregoing. The voice coil includes two tensile wires. The support piece surrounds the voice coil. The support piece comprises an upper surface and a lower surface, and the two tensile wires are located on the upper surface. The washer is located under the support piece. The two wires are respectively connected to the two tensile wires on an edge of the support piece.

In an embodiment, the upper surface of the support piece comprises two tensile wire guiding slots in which the two tensile wires are respectively placed.

In an embodiment, the lower surface of the support piece comprises a first wire guiding slot, an upper surface of the washer comprises a second wire guiding slot, and the first wire guiding slot and the second wire guiding slot are corresponding to each other, so that the two wires are located between the first wire guiding slot and the second wire guiding slot.

In an embodiment, the speaker further includes a T-shaped yoke. The T-shaped yoke comprises a hole, the washer comprises a penetrating hole, and the two wires pass through the penetrating hole and the hole, and are respectively fastened to the two terminals. Preferably, the speaker further includes an aluminum pipe. The two wires pass through the aluminum pipe and two ends of the aluminum pipe are respectively located in the penetrating hole of the washer and the hole of the T-shaped yoke.

In an embodiment, the speaker further includes a heat dissipation chamber. The terminal component is located in the heat dissipation chamber and an outer surface of the heat dissipation chamber is a plurality of heat dissipation fins.

In an embodiment, the speaker further includes sound-absorbing sponge. The sound-absorbing sponge is located in the heat dissipation chamber and the sound-absorbing sponge is located on the terminal component.

In summary, the terminal component in this application is hidden inside the heat dissipation chamber (for example, a rear chamber of a tweeter) and does not occupy any external size. That is, an interface location is hidden at the bottom of the speaker. When an input signal line is connected, it needs only to use a standard plug as a wiring terminal, which is similar to a sound box wiring manner, and is convenient for inserting, removing, and changing the speaker. In this way, various disadvantages of solder wiring can be further prevented, thereby improving a compression effect, improving structural compactness and stability, and eliminating phase interference, to obtain a good linear reaction.

BRIEF DESCRIPTION OF THE DRAWINGS

The present invention will become more fully understood from the detailed description given herein below for illustration only, and thus are not limitative of the present invention, and wherein.

DETAILED DESCRIPTION

To facilitate reading, this document points out "upper", "lower", "left", and "right" according to the figures. Its objective is to point out relative reference locations of components, but not to limit this application.

Figure 1:
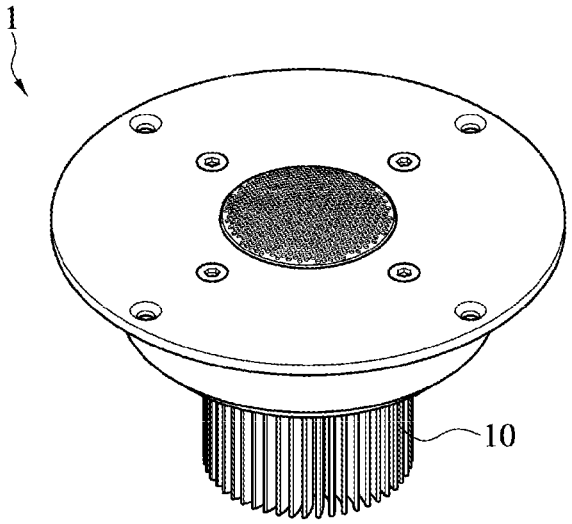
FIG. 1 is a schematic perspective diagram of an embodiment of a speaker according to this application.
Figure 2:
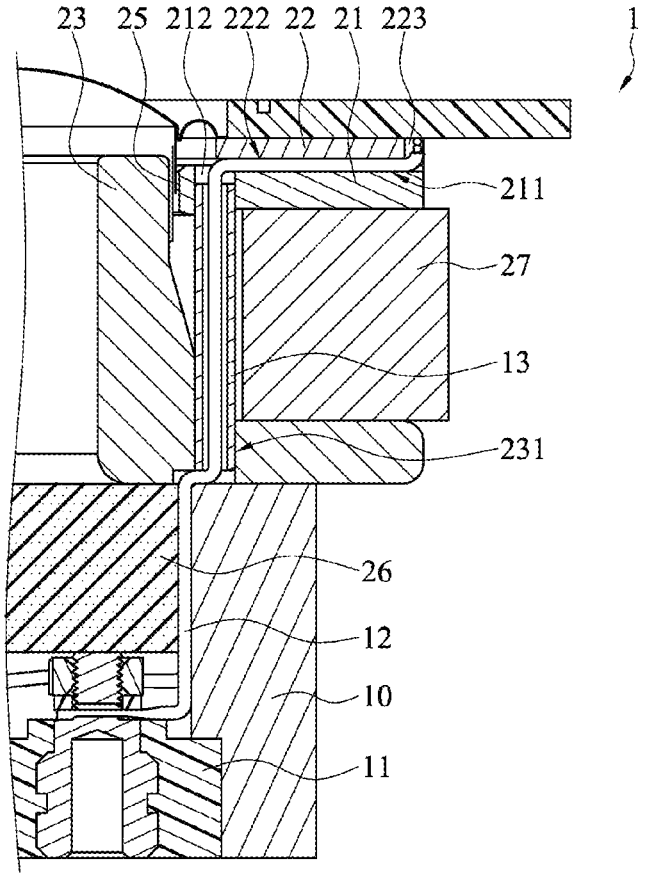
FIG. 2 is a partial schematic sectional diagram of FIG. 1.
Figure 3:
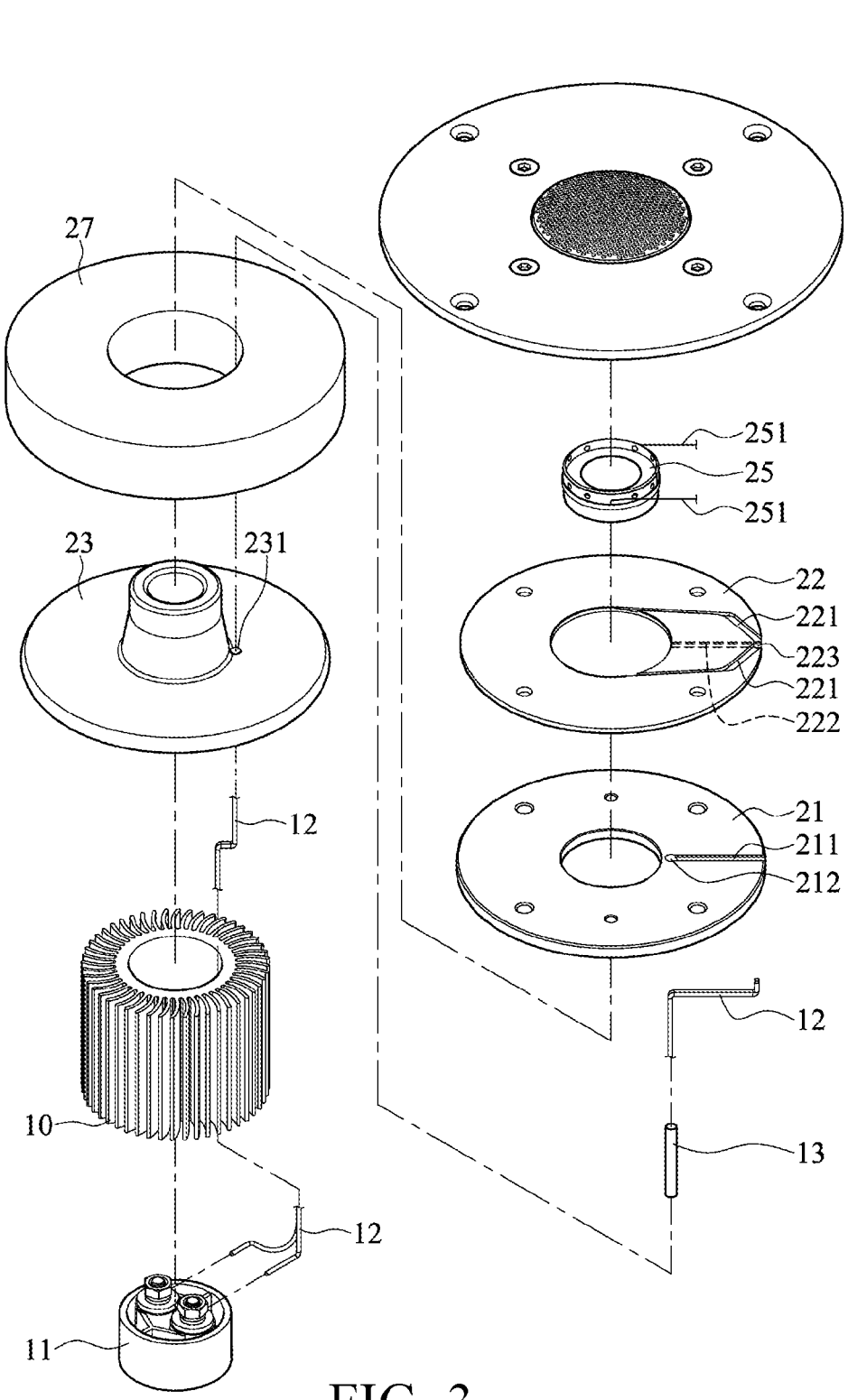
FIG. 3 is an explosive schematic perspective diagram of FIG. 1.

FIG. 1 is a schematic perspective diagram of a speaker 1. Referring to both FIG. 2 and FIG. 3, the speaker 1 includes a voice coil 25, a support piece 22, a washer 21, two wires 12, and a terminal component 11. The two wires 12 are substantially two parallel wires. The voice coil 25 includes two tensile wires 251 extending outward. The support piece 22 surrounds the voice coil 25. The two tensile wires 251 are located on an upper surface of the support piece 22. Preferably, the upper surface of the support piece 22 includes two tensile wire guiding slots 221 in which the two tensile wires 251 are placed. The washer 21 is located under the support piece 22. Preferably, the lower surface of the support piece 22 comprises a first wire guiding slot 222, an upper surface of the washer 21 comprises a second wire guiding slot 211, and the first wire guiding slot 222 and the second wire guiding slot 211 are corresponding to each other, so that the two wires 12 are located between the first wire guiding slot 222 and the second wire guiding slot 211. The two wires 12 are respectively connected to the two tensile wires 251, for example, directly welded to the two tensile wires 251. A connection hole 223 is disposed on an edge of the support piece 22, so that the two wires 12 extend downward to the terminal component 11 after the welding.

The tensile wires 251 are welded to the wires 12 and, therefore, the support piece 22 may be prevented from being damaged by scalding. In addition, a terminal plate structure may be omitted when the wires 12 are used. Therefore, an external diameter of the support piece 22 may be less than an external diameter of a magnet 27, and an overall size of the speaker 1 may be further decreased.

In an embodiment, the speaker 1 further includes a T-shaped yoke 23. The T-shaped yoke 23 includes a hole 231. The washer 21 includes a penetrating hole 212. The two wires 12 pass through the penetrating hole 212 and the hole 231. Preferably, the speaker 1 further includes an aluminum pipe 13 and the two wires 12 pass through the aluminum pipe 13. Two ends of the aluminum pipe 13 are located in the penetrating hole 212 of the washer 21 and the hole 231 of the T-shaped yoke 23, respectively. The aluminum pipe 13 additionally has a leading function, to lead the two wires 12 to successfully reach the terminal component 11, and prevent interference to and from another component (such as the T-shaped yoke or the magnet).

In an embodiment, the speaker 1 further includes a heat dissipation chamber 10. The terminal component 11 is located in the heat dissipation chamber 10 and an outer surface of the heat dissipation chamber 10 is a plurality of heat dissipation fins. Preferably, the speaker 1 further includes a sound-absorbing sponge 26. The sound-absorbing sponge 26 is also located in the heat dissipation chamber 10 and the sound-absorbing sponge 26 is located above the terminal component 11. Not only does the heat dissipation chamber 10 provide internal space for placing the terminal component 13, but also the internal space of the heat dissipation chamber 10 may reduce a treble resonance frequency. The fin structure of the external surface of the heat dissipation chamber 10 may further speed up heat dissipation.

Figure 4A:
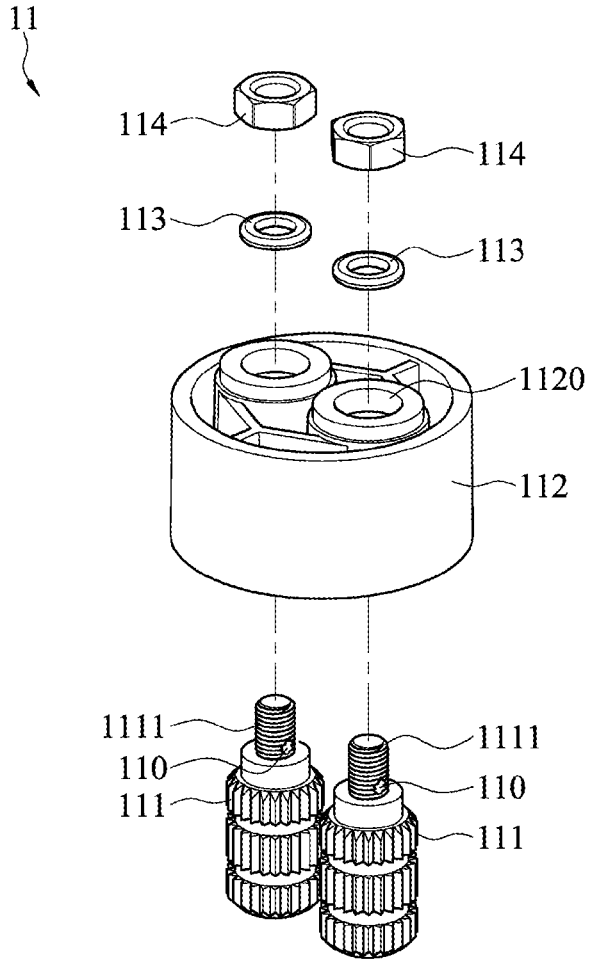
FIG. 4A is an explosive schematic perspective diagram of a terminal component according to this application.
Figure 4B:
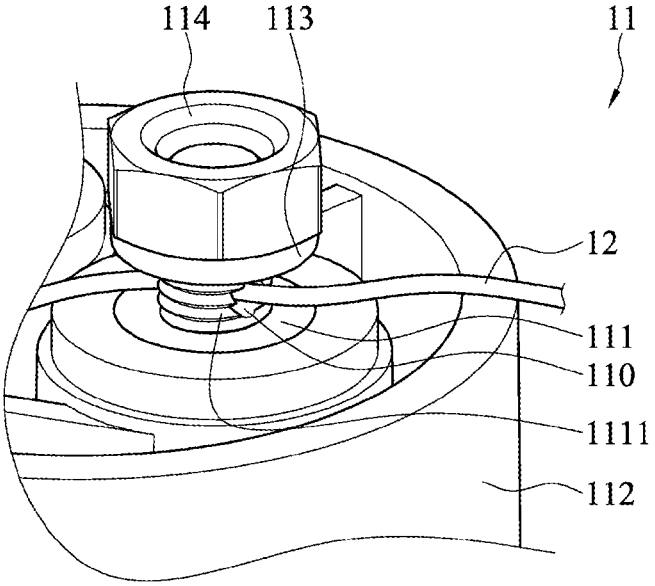
FIG. 4B is a partial schematic perspective diagram of a terminal component according to this application.

Referring to FIG. 4A and FIG. 4B, the terminal component 11 includes two terminals, a sleeve seat 112, and two fixing heads 114. Each terminal includes a terminal head 1111 and a terminal body 111. The sleeve seat 112 includes two terminal blocks 1120. The two terminal blocks 1120 respectively accommodate the two terminal bodies 111, and the two terminal heads 1111 are exposed outside the sleeve seat 112. The two fixing heads 114 are respectively combined with the two terminal heads 1111, to respectively fasten two wires 12 to the two terminals. For example, the fixing heads 114 may be nuts or the like, and the terminal heads 1111 are of a stud type, so the fixing heads 114 and the terminal heads 1111 may be fastened to each other through screwing. The two wires 12 may surround the terminal heads 1111, and may be more strongly fastened by using a shim body 113. Preferably, each terminal head 111 includes a punch hole 110 through which the wires 12 may pass.

The terminal component may be hidden inside the heat dissipation chamber (for example, a rear chamber of a tweeter) and does not occupy any external size. That is, an interface location is hidden at the bottom of the speaker. When an input signal line is connected, it needs only to use a standard plug as a wiring terminal, which is similar to a sound box wiring manner, and is convenient for inserting, removing, and changing the speaker. In this way, various disadvantages of solder wiring can be further prevented, thereby improving a compression effect, improving structural compactness and stability, and eliminating phase interference, to obtain a good linear reaction.

Although this application is disclosed above by using the embodiments, the embodiments are not used for limiting this application. Any person skilled in the art may perform some modifications and improvements without disobeying the spirit and scope of this application. Therefore, the protection scope of this application should be subject to the scope defined by the claims.

What is claimed is:

1. A terminal component, applied to a speaker, and comprising:

two terminals, each comprising a terminal head and a terminal body;

a sleeve seat, comprising two terminal blocks, wherein the two terminal blocks respectively accommodate the two terminal bodies, so that the terminal head of each terminal is exposed outside the sleeve seat; and two fixing heads, respectively combined with the terminal head of each terminal, to respectively fasten two wires to the two terminals, wherein the two wires are adapted to connect with two tensile wires of voice coil.

2. The terminal component according to claim 1, wherein each terminal head comprises a punch hole for the two wires to pass through, respectively.

3. A speaker, comprising:

a voice coil, comprising two tensile wires;

a support piece, surrounding the voice coil, wherein the support piece comprises an upper surface and a lower surface, and the two tensile wires are located on the upper surface;

a washer, located under the support piece;

two wires, wherein the two wires are respectively connected to the two tensile wires on an edge of the support piece; and a terminal component, comprising:

two terminals, each comprising a terminal head and a terminal body;

a sleeve seat, comprising two terminal blocks, wherein the two terminal blocks respectively accommodate the terminal body of each terminal, so that the terminal head of each terminal is exposed outside the sleeve seat; and two fixing heads, respectively combined with the two terminal heads, to respectively fasten two wires to the two terminals.

4. The speaker according to claim 3, wherein the upper surface of the support piece comprises two tensile wire guiding slots in which the two tensile wires are respectively placed.

5. The speaker according to claim 3, wherein the lower surface of the support piece comprises a first wire guiding slot, an upper surface of the washer comprises a second wire guiding slot, and the first wire guiding slot and the second wire guiding slot correspond to each other, so that the two wires are located between the first wire guiding slot and the second wire guiding slot.

6. The speaker according to claim 3, further comprising a T-shaped yoke, wherein the T-shaped yoke comprises a hole, the washer comprises a penetrating hole, and the two wires pass through the penetrating hole and the hole, and are respectively fastened to the two terminals.

7. The speaker according to claim 6, further comprising an aluminum pipe, wherein the two wires pass through the aluminum pipe, and two ends of the aluminum pipe are respectively located in the penetrating hole of the washer and the hole of the T-shaped yoke.

8. The speaker according to claim 3, further comprising a heat dissipation chamber, wherein the terminal component is located in the heat dissipation chamber, and an outer surface of the heat dissipation chamber is a plurality of heat dissipation fins.

9. The speaker according to claim 8, further comprising a sound-absorbing sponge, wherein the sound-absorbing sponge is located in the heat dissipation chamber, and the sound-absorbing sponge is located on the terminal component.

10. The speaker according to claim 3, wherein each terminal head comprises a punch hole for the two wires to pass through, respectively.

* * * * *